US008267720B2

(12) United States Patent
Ishida

(10) Patent No.: US 8,267,720 B2
(45) Date of Patent: Sep. 18, 2012

(54) SEAL STRUCTURE

(75) Inventor: Keiko Ishida, Makinohara (JP)

(73) Assignee: Yazaki Corporation, Tokyo (JP)

( * ) Notice: Subject to any disclaimer, the term of this patent is extended or adjusted under 35 U.S.C. 154(b) by 168 days.

(21) Appl. No.: 12/903,429

(22) Filed: Oct. 13, 2010

(65) Prior Publication Data

US 2011/0086545 A1 Apr. 14, 2011

(30) Foreign Application Priority Data

Oct. 14, 2009 (JP) ..... 2009-237119

(51) Int. Cl.
*H01R 13/40* (2006.01)

(52) U.S. Cl. ..... 439/587; 439/589

(58) Field of Classification Search ..... 439/587, 439/589, 274
See application file for complete search history.

(56) References Cited

U.S. PATENT DOCUMENTS 6,527,586 B2 * 3/2003 Okamura et al. ..... 439/587
6,739,908 B2 * 5/2004 Hamai et al. ..... 439/587
7,033,215 B2 * 4/2006 Kobayashi ..... 439/587
7,033,216 B2 * 4/2006 Ito ..... 439/587
7,637,764 B2 * 12/2009 Yoneda et al. ..... 439/275
7,927,138 B2 * 4/2011 Ambo et al. ..... 439/589

FOREIGN PATENT DOCUMENTS

JP 2009-048929 A 3/2009

* cited by examiner

*Primary Examiner* — Xuong Chung Trans
(74) *Attorney, Agent, or Firm* — Sughrue Mion, PLLC

(57) ABSTRACT

A seal structure includes a housing and a waterproof member provided in the housing. The waterproof member includes a body and electric wire insertion holes formed in the body for passing through electric wires respectively. Each of the electric wire insertion holes has a first insertion part and a second insertion part. An inner diameter of the second insertion part is larger than an inner diameter of the first insertion part. The first insertion part is adapted to hold a first electric wire and the second insertion part is adapted to hold a second electric wire. An outer diameter of the first electric wire is larger than an outer diameter of the second electric wire. An elastic portion attached to an outer periphery of the second electric wire is positioned at the first insertion part or the second insertion part in an intimate contact state.

5 Claims, 5 Drawing Sheets

SEAL STRUCTURE

BACKGROUND

The present invention relates to a seal structure for achieving waterproofing of a waterproof connector or the like.

FIG. 6 shows a related waterproof connector 100 described in JP-A-2009-48929. A terminal accommodation chamber 113 is formed in a housing 110 of the waterproof connector 100. A rubber plug attachment cavity 115 communicates with the terminal accommodation chamber 113 at an electric wire drawing side thereof (a rear side). A terminal metal fitting 125 coupled to an electric wire 120 is inserted into the terminal accommodation chamber 113. A rubber plug 130 and a pressing member 140 are inserted into the rubber plug attachment cavity 115.

The rubber plug 130 is formed of a silicon resin or the like and the outer diameter of the rubber plug 130 is larger than the rubber plug attachment cavity 115. The rubber plug 130 is inserted into the rubber plug attachment cavity 115 in a compressed state. An electric wire insertion hole 135 into which an electric wire 120 is to be inserted is formed on the rubber plug 130.

The pressing member 140 is formed of an insulation resin formed in a block shape and is to be inserted into the rubber plug attachment cavity 115 from a rear side of the rubber plug 130. An electric wire insertion hole 145 communicating with the electric wire insertion hole 135 of the rubber plug 130 is formed on the pressing member 140.

In the waterproof connector 100, a plurality of engagement recessed portions 117 forming a sawtooth configuration are formed on an inner face of the rubber plug attachment cavity 115 at an inlet part. An engagement projection portion 147 to be engaged with any one of the engagement recessed portions 117 is formed on an outer face of the pressing member 140.

In the waterproof connector 100, the electric wire 120 is inserted into the electric wire insertion hole 145 of the pressing member 140 and the electric wire insertion hole 135 of the rubber plug 130. Under the above condition, the terminal metal fitting 125 is inserted into the terminal accommodation chamber 113 and the rubber plug 130 is inserted into the rubber plug attachment cavity 115. After that, the pressing member 140 is inserted into the rubber plug attachment cavity 115 from the rear side of the rubber plug 130 so as to press the rubber plug 130, thereby engaging the engagement projection portion 147 with one of the engagement recessed portion 117 of the rubber plug attachment cavity 115. By the engagement, the rubber plug 130 and the pressing member 140 are fixed to the housing 110.

With the above configuration, since the rubber plug 130 is compressed by the pressing of the pressing member 140, an outer face of the rubber plug 130 is brought into intimate contact with the inner face of the rubber plug attachment cavity 115 as well as the electric wire insertion hole 135 is brought into intimate contact with an outer face of the electric wire 120. Accordingly, the electric wire 120 can be held in a waterproof state.

In the waterproof connector 100 shown in FIG. 6, when an electric wire 120 having a small outer diameter (a thin electric wire) is attached, the pressing member 140 is further pushed thereinto along a longitudinal direction of the electric wire 120 and the engagement projection portion 147 is engaged with the engagement recessed portion 117 at the front side. Accordingly, since the diameter of the electric wire insertion hole 135 of the rubber plug 130 is further reduced, the rubber plug 130 can be brought into intimate contact with the thin electric wire 120. Therefore, even when diameters of the electric wires 120 are different from each other, the electric wires can be attached to the housing 110.

However, in the above related waterproof connector 100, it is necessary to adjust a pushing amount of the pressing member 140 depending on each of the electric wires having the different diameters. Therefore, a work for attaching of a plurality of electric wires having different diameters has been troublesome.

In the above circumstances, a mat seal capable of achieving integral waterproofing of electric wires having different diameters has been developed in recent years. The mat seal has a body made of insulation resin and a plurality of electric wire insertion holes formed in the body. The body has a block plate shape.

The body of the mat seal is fitted into an attachment cavity of a housing so as to be in intimate contact with an inner face of the attachment cavity. A lip portion is provided at the inner face of each of the electric wire insertion holes in the mat seal so as to be projected in a wave shape. A projection amount of the lip portion in each of the electric wire insertion holes is set so as to be matched with the diameter of the electric wire to be inserted thereinto. Accordingly, the inner face of each of the electric wire insertion hole can be in intimate contact with the electric wire. In the above described mat seal, since each of the electric wire insertion holes (the lip portion) is in intimate contact with the outer face of the electric wire by inserting the electric wire into the electric wire insertion hole whose diameter is matched with the diameter of the electric wire, it is possible to allow the mat seal to have a structure achieving waterproofing without attachment of a rubber plug even when the electric wires have different diameters. For this reason, it is possible to achieve integral waterproofing.

However, in the mat seal, it is necessary to change the projection amounts (the inner diameters of the electric wire insertion holes) of the lip portions of the electric wire insertion holes so as to be matched with the diameters of the electric wires so as to form electric wire insertion holes having different inner diameters on the mat seal. Therefore, in a case where a number of circuit patterns is increased and a number of kinds of the diameters of the electric wires is increased, it is necessary to prepare many kinds of (part numbers) of the mat seals so that problems arise that selecting of the mat seal is complicated or troublesome, and thereby, the cost is increased.

SUMMARY

In view of the above problems, a purpose of the invention is to provide a seal structure that allows electric wire insertion holes of a mat seal to be in intimate contact with electric wires having different diameters even when the number of kinds of diameters of the electric wires is increased so as to obviate the need for increasing the kinds of mat seals, to facilitate the selection of the mat seal and to reduce the cost.

In order to achieve the above object, according to the present invention, there is provided a seal structure comprising:

a housing; and a waterproof member provided in the housing, wherein the waterproof member includes a body and a plurality of electric wire insertion holes formed in the body for passing through a plurality of electric wires respectively;

wherein each of the plurality of electric wire insertion holes has a first insertion part and a second insertion part communicated with the first insertion part;

wherein an inner diameter of the second insertion part is larger than an inner diameter of the first insertion part;

wherein the first insertion part is adapted to hold a first electric wire among the electric wires and the second insertion part is adapted to hold a second electric wire among the electric wires;

wherein an outer diameter of the first electric wire is larger than an outer diameter of the second electric wire; and wherein an elastic portion attached to an outer periphery of the second electric wire is positioned at the first insertion part or the second insertion part in an intimate contact state.

In accordance with the above configuration, a seal structure is so constituted that a first insertion part having an inner diameter corresponding to the first electric wire and the second insertion part having a diameter corresponding to the second electric wire are formed in each of the electric wire insertion holes of the waterproof member and the elastic portion attached to the outer periphery of the first electric wire is brought into intimate contact with the first insertion part or the second insertion part. As a result of the above configuration, the waterproofing of the first electric wire can be achieved by the first insertion part and the waterproofing of the second electric wire can be achieved by the first insertion part or the second insertion part via the elastic portion.

With the above structure, the first insertion part and the second insertion part formed in each of the electric wire insertion holes are respectively in intimate contact with the electric wires having different diameters so as to achieve steady waterproofing. Therefore, it is possible to obviate the need for forming electric wire insertion holes having different diameters on the waterproof member. Accordingly, it is possible to obviate the need for increasing the number of kinds of the waterproof members, to facilitate the selection of the waterproof member and to reduce the cost.

Preferably, the elastic portion attached to the outer periphery of the second electric wire is positioned at only the second insertion part in the intimate contact state.

In accordance with the above configuration, the elastic portion of the second electric wire is in intimate contact with only the second insertion part of the electric wire insertion hole, steady waterproofing of the second electric wire can be achieved by the second insertion part.

Preferably, a plurality of first protrusion portions are formed on an inner periphery face of the first insertion part, a plurality of second protrusion portions are formed on an inner periphery face of the second insertion part, and a distance between apexes of the second protrusion portions in a direction perpendicular to the inner periphery face of the second insertion part is larger than a distance between apexes of the first protrusion portions in a direction perpendicular to the inner periphery face of the first insertion part.

Preferably, the waterproof member is a mat seal made of an elastic material.

Preferably, the elastic portion is an annular rubber plug.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Figure 1:
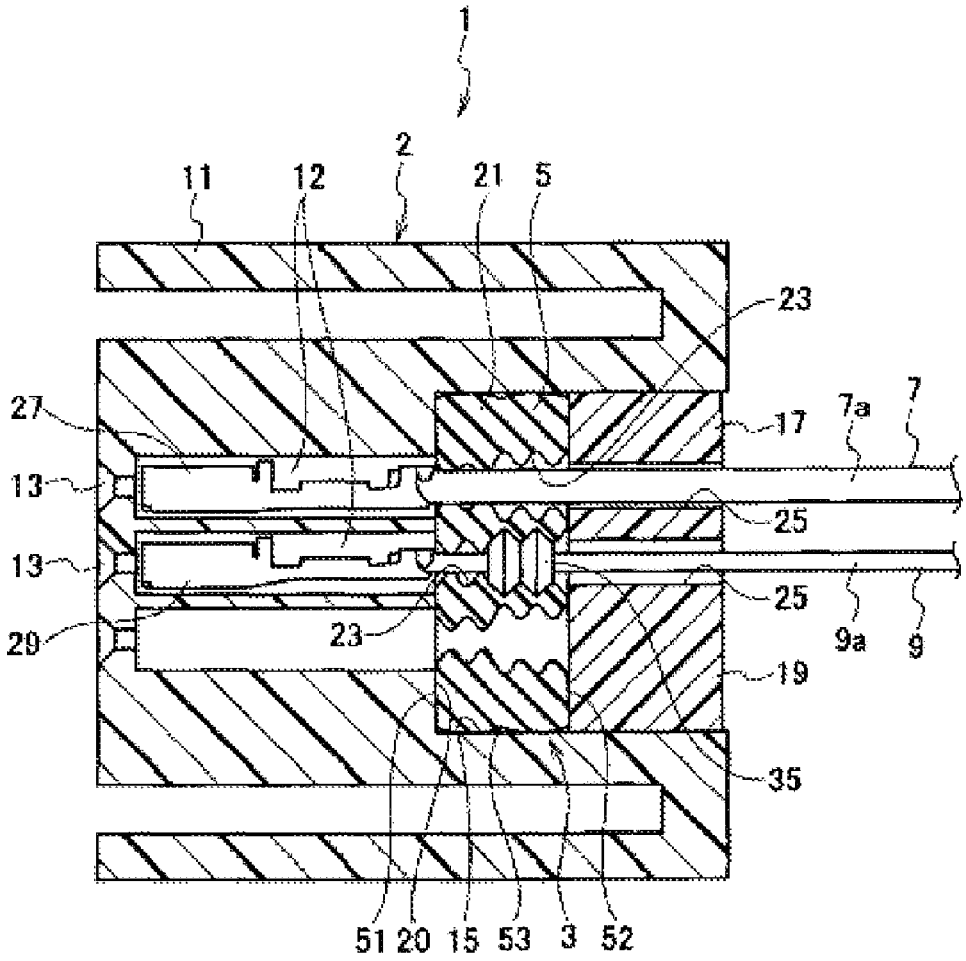
FIG. 1 is a cross sectional view showing a waterproof connector having a seal structure according to an embodiment of the invention.
Figure 2A:
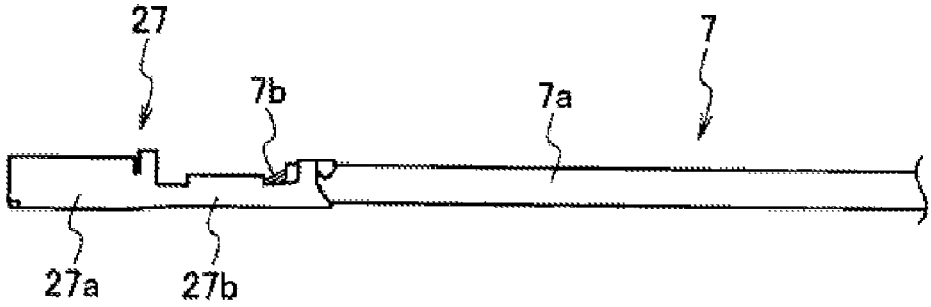
FIGS. 2A and 2B are side views showing electric wires used in the embodiment of the invention.
Figure 2B:
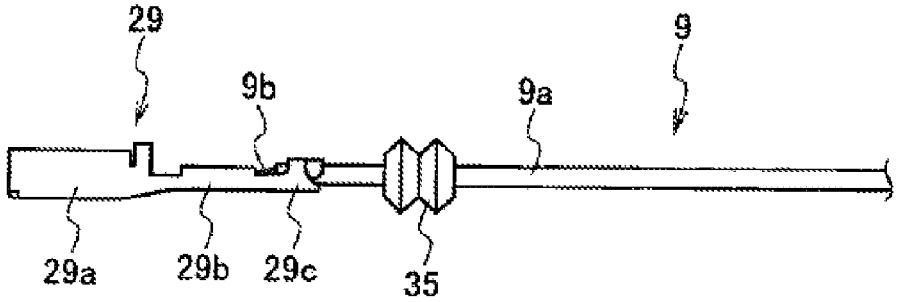
Figure 3:
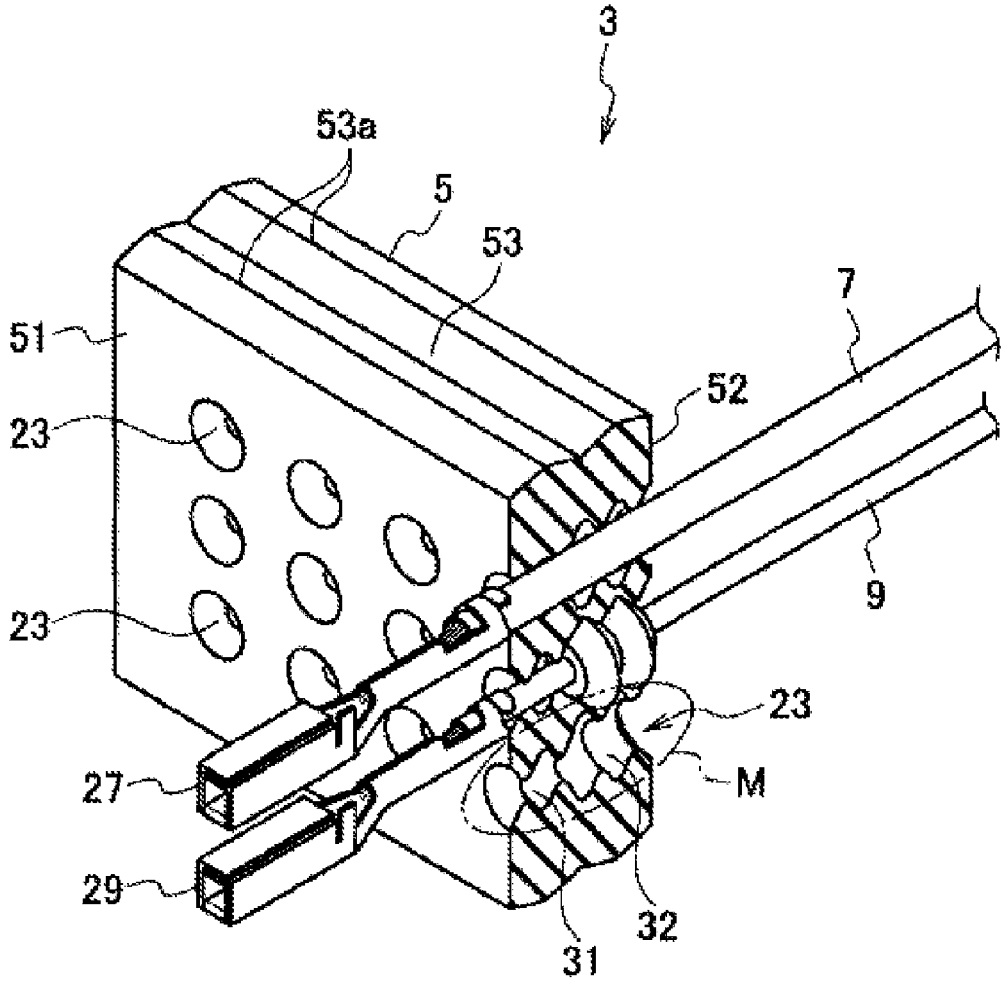
FIG. 3 is a perspective view showing a waterproof structure according to the embodiment of the invention.
Figure 4:
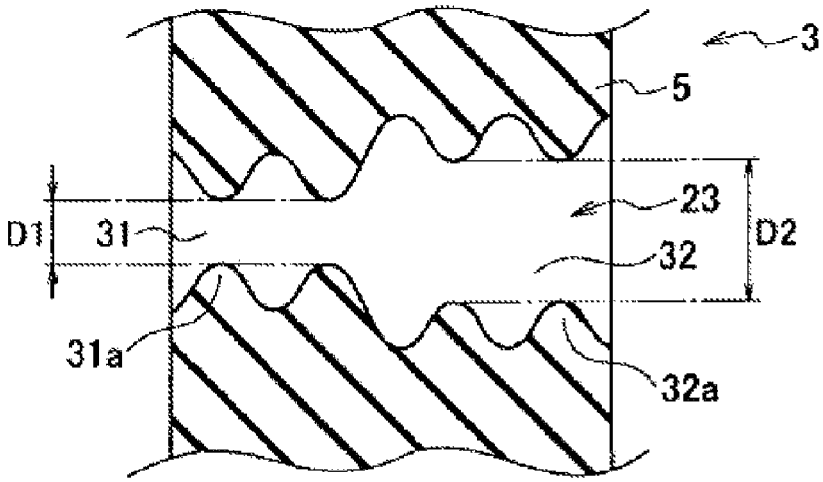
FIG. 4 is an enlarged cross sectional view showing an M part shown in FIG. 3.

Preferred embodiments of the invention will be described with reference to the accompanying drawings. FIGS. 1 through 5 show an embodiment of the invention. FIG. 1 is a cross sectional view showing a waterproof connector 1 having a seal structure according to the embodiment of the invention. FIGS. 2A and 2B are side views showing electric wires used in the waterproof connector 1. FIG. 3 is a perspective view showing a seal structure 3. FIG. 4 is an enlarged cross sectional view of an M part shown in FIG. 3.

As shown in FIG. 1, the waterproof connector 1 includes a housing 2, a mat seal 5, and a plurality of electric wires 7 and 9. The electric wire 7 is a thick electric wire having a large outer diameter. The electric wire 9 is a thin electric wire having a small outer diameter smaller than the large outer diameter of the electric wire 7.

The housing 2 is to be coupled to a counterpart connector (not shown) and a coupling hood 11 for coupling to the counterpart connector is formed at the outside of the housing 2. The entirety of the housing 2 is formed of an insulation resin so as to have a shape as shown in FIG. 1. A plurality of terminal accommodation chambers 12 are formed in the housing 2 so as to be separated from one another. Counterpart terminal insertion holes 13 for inserting respective counterpart terminals (not shown) are formed at a front face portion of the housing 2 corresponding to the respective terminal accommodation chambers 12.

A mat seal attachment cavity 15 is formed at a rear side of the terminal accommodation chambers 12. A diameter of the mat seal attachment cavity 15 is greater than a total dimension of diameters of all of the terminal accommodation chambers 12. The mat seal attachment cavity 15 extends toward an electric wire drawing side (a rear face side) 17 of the housing 2, and the mat seal 5 and a pressing member 19 are attached in the mat seal attachment cavity 15. In the above case, a stopper wall 20 as a front wall of the mat seal attachment cavity 15 is formed in the housing 2.

The mat seal 5 constitutes a seal structure 3 of the embodiment. As shown in FIGS. 1 and 3, the mat seal 5 includes a body 21 formed of an insulation resin such as a rubber, a silicone resin or the like and a plurality of electric wire insertions holes 23 passing through the body 21 in the thickness direction.

The body 21 of the mat seal 5 is inserted into the mat seal attachment cavity 15 of the housing 2. The body 21 of the mat seal 5 is formed in a block plate shape having a front face wall 51, a rear face wall 52 and an outer face wall 53. An outer dimension of the mat seal 5 is slightly larger than an inner dimension of the mat seal attachment cavity 15 of the housing 2. When the mat seal 5 is inserted into the mat seal attachment cavity 15, the front face wall 51 of the body 21 abuts the stopper wall 20 of the housing 2 so as to be in intimate contact with the stopper wall 20 thereof, and the outer face wall 53 abuts the inner face of the mat seal attachment cavity 15 of the housing 2 so as to be in intimate contact with the inner face thereof. In the embodiment, as shown in FIG. 3, an annular projection portion 53*a* is formed over the entire circumference of the outer face wall 53. Since the annular projection portion 53*a* is pressed against the inner face of the mat seal attachment cavity 15, the projection portion 53*a* can be brought into intimate contact with the inner face of the mat seal attachment cavity 15. The pressing member 19 abuts to the rear face wall 52 of the body 21.

The pressing member 19 is formed of an insulation resin, and electric wire insertion holes 25 communicating with the electric wire insertions holes 23 are formed on the pressing member 19. The pressing member 19 is to be inserted into the mat seal attachment cavity 15 from the rear side of the mat seal 5, and an engaging portion to be engaged with the housing 2 is formed on the pressing member 19 and the housing 2. As the engaging portion, recessed and projection portions for being mutually engaged with each other or a hook portion can be formed on the pressing member 19 and the housing 2. By engaging of the engaging portion, the pressing member 19 is fixed at the rear side of the mat seal 5 so that it is possible to maintain an attaching state of the mat seal 5 to the housing 2.

FIG. 4 shows in detail each of the electric wire insertion holes 23 formed in the body 21 of the mat seal 5. Each of the electric wire insertion holes 23 has a first insertion part 31 and a second insertion part 32 communicate with each other so that the electric wire insertion holes 23 pass through the body 21 in the thickness direction, respectively.

In each of the electric wire insertion holes 23, the first insertion parts 31 has an inner diameter D1 corresponding to an outer diameter of the thick electric wire 7. The second insertion parts 32 has an inner diameter D2 corresponding to an outer diameter of the thin electric wire 9 having a rubber plug 35. In the embodiment, an inner face of the first insertion part 31 and an inner face of the second insertion part 32 have respectively protruding lip portions 31*a* and 32*a* each having a wave shape. The inner diameters D1 and D2 of the first and second insertion parts 31 and 32 are determined by respective apexes of the lip portions 31*a* and 32*a* of the first and second insertion parts 31 and 32. Here, the diameter D2 corresponding to the thin electric wire 9 is set to be larger than the diameter D1 corresponding to thick electric wire 7 (D2>D1). In the embodiment, while the first insertion part 31 corresponding to the thick electric wire 7 is positioned at the front side and the second insertion part 32 corresponding to the thick electric wire 9 is positioned at the rear side, the order of the first and second insertion parts 31 and 32 in the position may be changed to the reverse order.

FIG. 2A shows the thick electric wire 7 and FIG. 2B shows the thin electric wire 9. The electric wires 7 and 9 are respectively formed of covered electric wires 7*a* and 9*a* and terminal metal fittings 27 and 29 attached to the respective tip end portions of the covered electric wires 7*a* and 9*a*. The terminal metal fittings 27 and 29 respectively have counterpart terminal metal fitting sections 27*a* and 29*a* at respective tip end portions and joint sections 27*b* and 29*b* at respective rear end portions to be coupled to respective core wires 7*b* and 9*b* drawn from the covered electric wires 7*a* and 9*a* by pressure fastening. A barrel portion 29*c* coupled to the tip end portion of the covered electric wire 9*a* by pressure fastening is formed on the terminal metal fitting 29 at the thin electric wire 9 side.

Next, function of the mat seal 5 in the embodiment is described below. When the thick electric wire 7 is inserted into the electric wire insertion hole 23 of the mat seal 5, the first insertion part 31 having the inner diameter D1 which corresponds to the outer diameter of the thick electric wire 7 is brought into intimate contact with the thick electric wire 7. Namely, the lip portion 31*a* of the first insertion part 31 is brought into contact with the thick electric wire 7. Accordingly, it is possible to prevent water, intending to move along the thick electric wire 7, from entering from the electric wire drawing side 17.

The rubber plug 35 is attached to the outer periphery of the thin electric wire 9 as shown in FIG. 2B. The rubber plug 35 can be attached to the outer periphery of the covered electric wire 9*a* by pressure fastening or molding. The rubber plug 35 has an outer diameter that is slightly larger than the inner diameter D2 of the second insertion part 32 of the electric wire insertion hole 23. The attachment position of the rubber plug 35 is set so as to be on a position corresponding to the second insertion part 32 of the electric wire insertion hole 23. When the thin electric wire 9 having the rubber plug 35 attached to the outer periphery thereof, is inserted into the electric wire insertion hole 23 of the mat seal 5, the rubber plug 35 is brought into intimate contact with the second insertion part 32 of the electric wire insertion hole 23. Namely, the lip portion 32*a* of the second insertion part 32 is brought into intimate contact with the thin electric wire 9 through the rubber plug 35. Accordingly, it is possible to prevent water, intending to move along the thing electric wire 9, from entering from the electric wire drawing side 17.

Also, the rubber plug 35 having an outer diameter that is slightly larger than the inner diameter D1 of the first insertion part 31 of the electric wire insertion hole 23 is attached to the thin electric wire 9. When the thin electric wire 9 is inserted into the electric wire insertion hole 23, the rubber plug 35 of the electric wire 9 may be positioned and brought into intimate contact with the first insertion part 31 of the electric wire insertion hole 23. Therefore, also in the above case, it is possible to prevent water, intending to move along the thin electric wire 9, from entering from the electric wire drawing side 17.

An assembling process of the waterproof connector 1 of the embodiment is described below. As described above, in the embodiment, the thick electric wire 7 having the large outer diameter and the thin electric wire having the small outer diameter smaller than the large outer diameter of the thick electric wire 7 are attached to the waterproof connector 1.

First, the electric wires 7 and 9 are respectively inserted into the electric wire insertion holes 23 of the mat seal 5 and the electric wire insertion holes 25 of the pressing member 19. The terminal metal fittings 27 and 29 are attached to the respective tip end portions of the electric wires 7 and 9. The terminal metal fittings 27 and 29 are inserted into the corresponding terminal accommodation chambers 12 from the electric wire drawing side 17 of the housing 2. By the insertion, the mat seal 5 is fitted to the mat seal attachment cavity 15. After that, the pressing member 19 is pushed from the rear side of the mat seal 5 so as to be inserted into the mat seal attachment cavity 15, and thereby, the pressing member 19 is fixed. Accordingly, the electric wires 7 and 9 having different diameters can be simultaneously attached to the housing 2 in a waterproof state.

In the above embodiment, the first insertion part 31 of the electric wire insertion hole 23 is in intimate contact with the thick electric wire 7 so as to achieve waterproofing, and the second insertion part 32 or the first insertion part 31 is in intimate contact with the rubber plug 35 of the thin electric wire 9 so as to achieve waterproofing. Thus, in the embodiment, it is not necessary to form, in the mat seal 5, electric wire insertion holes that are respectively matched with the diameters of the thick electric wires 7 and the thin electric wires 9. Accordingly, it is possible to obviate the need for increasing the number of kinds of the mat seals 5, to facilitate the selection of the mat seal 5 and to reduce the cost. In addition, since the waterproofing can be achieved by only the mat seal 5, it is not necessary to use any other member for waterproofing, the number of components for waterproofing is not increased, and thereby, the structure can be simplified.

Figure 5:
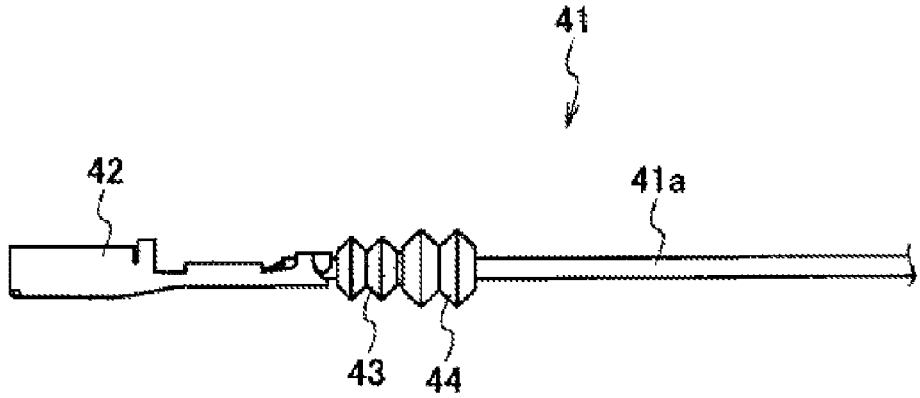
FIG. 5 is a side view showing another electric wire used in the invention.
Figure 6:
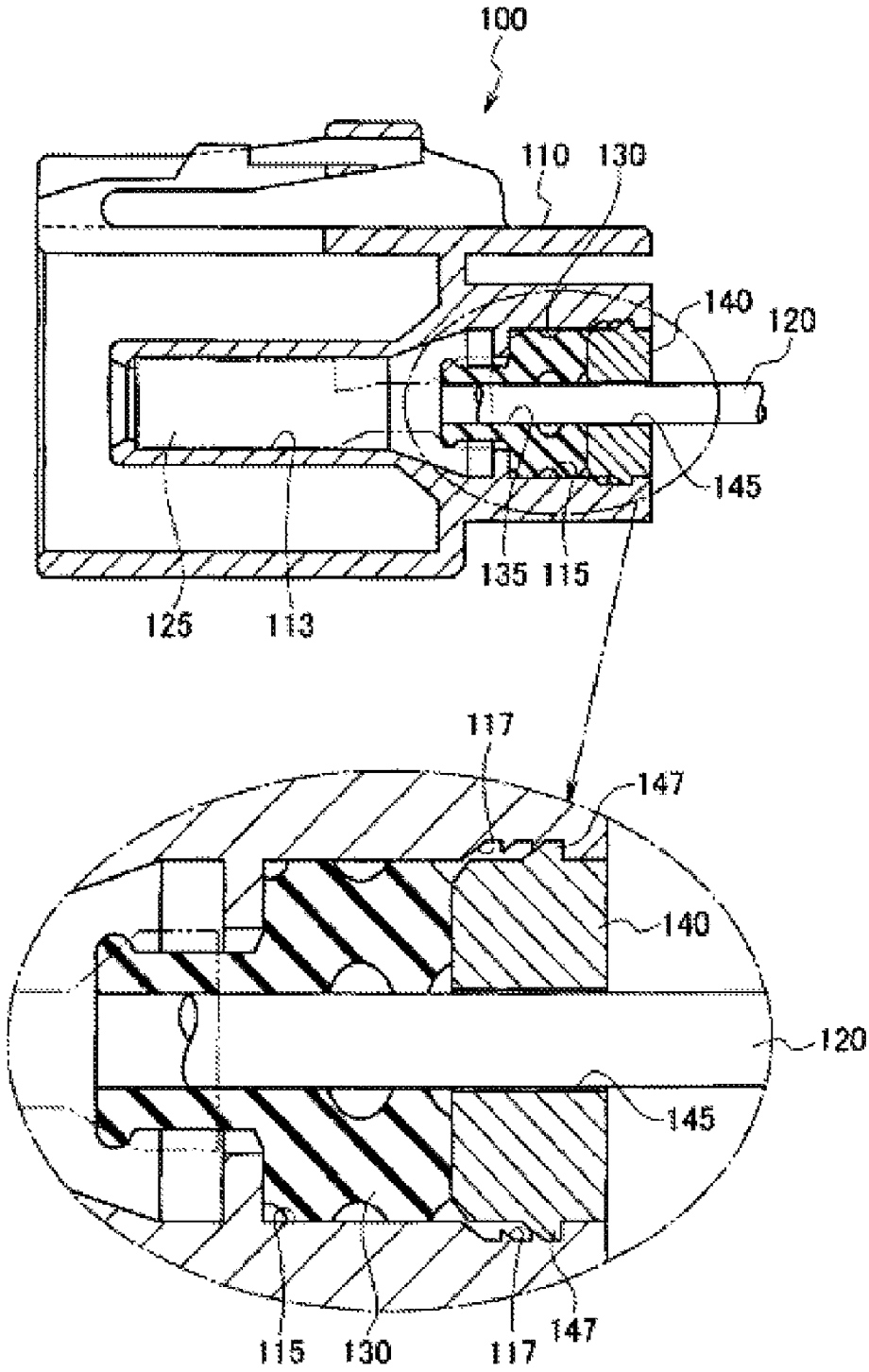
FIG. 6 is a schematic view including an entire cross sectional view and a partial cross sectional view of a waterproof connector of a related art.

FIG. 5 shows a case where an intermediate electric wire 41 having an outer diameter that is in an intermediate size between sizes of the thick electric wire 7 and the thin electric wire 9, is used in the seal structure 3 of the embodiment. The intermediate electric wire 41 is configured that a terminal metal fitting 42 is attached to a tip end portion of a covered electric wire 41*a* similarly to the thick electric wire 7 and the thin electric wire 9 as shown in FIG. 2. A first rubber plug 43 and a second rubber plug 44 are attached to an outer periphery of the covered electric wire 41*a* of the intermediate electric wire 41.

The first rubber plug 43 is positioned at the first insertion part 31 of the electric wire insertion hole 23 of the mat seal 5 and the second rubber plug 44 is positioned at the second insertion part 32 of the electric wire insertion hole 23. Accordingly, the first rubber plug 43 has an outer diameter that is slightly larger than the inner diameter D1 of the first insertion part 31 and an outer diameter of the second rubber plug 44 has an outer diameter that is slightly larger than the inner diameter D2 of the second insertion part 32.

When the above described intermediate electric wire 41 is inserted into the electric wire insertion hole 23 of the mat seal 5, the first rubber plug 43 is brought into intimate contact with the first insertion part 31 and the second rubber plug 44 is brought into intimate contact with the second insertion part 32. The intimate contacting makes it possible to prevent water, intending to move along the intermediate wire 41, from entering. In the intermediate electric wire 41, one of the first and second rubber plugs 43 and 44 can be omitted.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2009-237119 filed on Oct. 14, 2009, the contents of which are incorporated herein by reference.

What is claimed is:

1. A seal structure comprising:

a housing; and a waterproof member provided in the housing, wherein the waterproof member includes a body and a plurality of electric wire insertion holes formed in the body for passing through a plurality of electric wires respectively;

wherein each of the plurality of electric wire insertion holes has a first insertion part and a second insertion part communicated with the first insertion part;

wherein an inner diameter of the second insertion part is larger than an inner diameter of the first insertion part;

wherein the first insertion part is adapted to hold a first electric wire among the electric wires and the second insertion part is adapted to hold a second electric wire among the electric wires;

wherein an outer diameter of the first electric wire is larger than an outer diameter of the second electric wire; and wherein an elastic portion attached to an outer periphery of the second electric wire is positioned at the first insertion part or the second insertion part in an intimate contact state.

2. The seal structure according to claim 1, wherein the elastic portion attached to the outer periphery of the second electric wire is positioned at only the second insertion part in the intimate contact state.

3. The seal structure according to claim 1, wherein a plurality of first protrusion portions are formed on an inner periphery face of the first insertion part;

wherein a plurality of second protrusion portions are formed on an inner periphery face of the second insertion part; and wherein a distance between apexes of the second protrusion portions in a direction perpendicular to the inner periphery face of the second insertion part is larger than a distance between apexes of the first protrusion portions in a direction perpendicular to the inner periphery face of the first insertion part.

4. The seal structure according to claim 1, wherein the waterproof member is a mat seal made of an elastic material.

5. The seal structure according to claim 1, wherein the elastic portion is an annular rubber plug.

* * * * *